US010670033B2

(12) United States Patent
Hökby

(10) Patent No.: US 10,670,033 B2
(45) Date of Patent: Jun. 2, 2020

(54) PUMP FOR A FLUID

(71) Applicant: Sulzer Management AG, Winterthur (CH)

(72) Inventor: Nils Hökby, Saltsjöbaden (SE)

(73) Assignee: SULZER MANAGEMENT AG, Winterthur (CH)

( * ) Notice: Subject to any disclaimer, the term of this patent is extended or adjusted under 35 U.S.C. 154(b) by 88 days.

(21) Appl. No.: 16/175,068

(22) Filed: Oct. 30, 2018

(65) Prior Publication Data

US 2019/0154051 A1 May 23, 2019

(30) Foreign Application Priority Data

Nov. 20, 2017 (EP) ..... 17202569

(51) Int. Cl.
*F04D 29/12* (2006.01)
*F04D 1/06* (2006.01)
(Continued)

(52) U.S. Cl.
CPC ..... *F04D 29/126* (2013.01); *F04D 1/06* (2013.01); *F04D 7/04* (2013.01); *F04D 29/086* (2013.01); *F04D 29/708* (2013.01); *F04D 13/06* (2013.01)

(58) Field of Classification Search
CPC ... F04D 7/02; F04D 7/045; F04D 7/04; F04D 29/12; F04D 29/708; F04D 29/10;
(Continued)

(56) References Cited

U.S. PATENT DOCUMENTS 846,747 A * 3/1907 Kerr ..... F04D 29/126 415/113
1,369,508 A * 2/1921 Weiner ..... F04D 29/167 277/579

(Continued)

FOREIGN PATENT DOCUMENTS

| | | |
|---|---|---|
| DE | 2616774 A1 | 10/1977 |
| EP | 3150856 A1 | 4/2017 |
| GB | 507029 A | 6/1936 |

OTHER PUBLICATIONS

Extended European Search Report dated May 2, 2018 in corresponding European Patent Application No. 17202569.4, filed Nov. 20, 2017.

*Primary Examiner* — Michael Lebentritt
*Assistant Examiner* — Topaz L. Elliott
(74) *Attorney, Agent, or Firm* — Global IP Counselors, LLP

(57) ABSTRACT

A pump includes first and second impellers and a sealing element. The sealing element is arranged between the first and second impellers around the drive shaft. The sealing element has a first end transvers to the drive shaft and facing the first impeller and a second end transverse to the drive shaft facing the second impeller. The sealing element has a length along an axis smaller than the distance between the first and second impellers such that the sealing element is movable along the axis between the first and second impellers. The first and second ends of the sealing element have first and second areas transverse to the axis, the first area being larger than the second area such that the force exerted by the lower pressure generated by the first impeller is substantially equal to the force exerted by the higher pressure generated by the second impeller.

12 Claims, 5 Drawing Sheets

(51) Int. Cl.

| | |
|---|---|
| ***F04D 29/08*** | (2006.01) |
| ***F04D 7/04*** | (2006.01) |
| ***F04D 29/70*** | (2006.01) |
| ***F04D 13/06*** | (2006.01) |

(58) Field of Classification Search
CPC .... F04D 29/106; F04D 29/126; F04D 29/128; F04D 29/086; F04D 29/167; F04D 1/06–10
See application file for complete search history.

(56) References Cited

U.S. PATENT DOCUMENTS 4,083,647 A * 4/1978 Tatkov ..... F04D 7/04 277/422
4,966,708 A * 10/1990 Oklejas ..... B01D 61/022 210/321.65
4,983,305 A * 1/1991 Oklejas ..... B01D 61/022 210/321.66
8,556,580 B2 * 10/2013 Stair ..... F04D 7/045 415/199.2
9,677,560 B1 * 6/2017 Davis ..... F04D 25/0686
10,280,924 B2 * 5/2019 Hokby ..... F04D 1/10
2003/0002977 A1 * 1/2003 Camatti ..... F04D 29/083 415/104
2004/0067132 A1 * 4/2004 Addie ..... F04D 29/167 415/170.1
2005/0123395 A1 * 6/2005 Addie ..... F04D 29/128 415/172.1
2011/0194926 A1 * 8/2011 Stair ..... F04D 7/045 415/1
2017/0089343 A1 * 3/2017 Hokby ..... F04D 1/10
2018/0106378 A1 * 4/2018 Itadani ..... F16J 15/34

* cited by examiner

PUMP FOR A FLUID

CROSS-REFERENCE TO RELATED APPLICATION

This application claims priority to European Application No. 17202569.4, filed Nov. 20, 2017, the contents of which are hereby incorporated herein by reference.

FIELD OF THE INVENTION

The present invention relates to a pump for a fluid.

BACKGROUND OF THE INVENTION

Different types of pumps are used within many different technical areas. One particular area where reliable and efficient pumps are essential is in mines or pits where pumps run more or less constantly to drain water from the mine or pits.

Pumps used for pumping water containing for example sand and other particles are exposed to considerable wear from the sand and particles that are flowing through the channels and the different parts in the pump. Pumps designed for these conditions are robust to resist these rough conditions but it is not easy to find resistant sealing that can be arranged between moving parts within the pump for long periods of time without being worn out by sand particles or other particles in the pumped water or fluid.

One commonly used type of sealing is mechanical resilient sealings that are arranged to be in contact with the moving part to seal a gap or space between adjacent parts. However, these seals are destroyed, by overheating, if they run with low, or without, cooling fluid, for example during start up or testing. Consequently, it is difficult to provide the required reliable sealing between different moving parts within the pump to ensure that the pump is working as intended over a long period of time. Especially in the areas of the pump where there is a high pressure involved and the fluid may contain particles of different sizes and material.

SUMMARY

There is consequently a need for an improved pump with a sealing arrangement suitable for pumps intended for pumping water or fluid comprising sand or other particles.

The present invention, as discussed herein, relates to a pump for fluids that to at least some extent fulfils the needs defined above.

The pump according to one aspect of the invention comprises:

a pump housing;

a power source;

a drive shaft connected to the power source and extending along an axis A;

a fluid inlet;

a first impeller rotated by said drive shaft and comprising a first impeller inlet in fluid connection with the fluid inlet, and a first impeller outlet;

a second impeller rotated by the drive and comprising a second impeller inlet in fluid connection with the first impeller outlet, and a second impeller outlet; and a sealing element stationary arranged in relation to the drive shaft and first and second impellers, the sealing element is sleeve shaped and arranged between the first and second impellers around the drive shaft, the sealing element has a first end transverse to the drive shaft and facing the first impeller and a second end transverse to the drive shaft facing the second impeller, the sealing element has a length along axis A smaller than the distance between the first and second impellers such that the sealing element is movable along axis A between the first and second impellers, wherein the first end of sealing element has a first area transverse to axis A and the second end has a second area transverse to axis A, and the first area is larger than the second area such that the force exerted by the lower pressure generated by the first impeller and the first area is substantially equal to the force exerted by the higher pressure generated by the second impeller and the second area.

The pump according to the invention fulfils the needs defined above since the sealing element is slightly shorter than the distance between the first and second impellers along the axial direction, and the sealing element is able to move between the first and the second impeller depending on the pressure generated by the first and second impellers. Since the sealing element is slightly shorter than the distance between the first and second impellers, contact between the adjacent surfaces is limited which makes it possible to manufacture the sealing element in a material that is strong and resistant to wear. The small gap between the sealing element and the first and second impellers furthermore prevents wear between the sealing element and the first and/or second impeller when the pump is started and no water is flowing through the pump which otherwise would damage the sealing element.

The movable sealing element and the gap between the sealing element and the first and second impellers has also turned out to work well when the fluid comprises particles, like for example, sand since the small gap will allow a limited flow of fluid from the second impeller towards the first impeller which removes particles settled between the sealing element and the first or second impeller, or the shaft.

The area of the first and second areas on the sealing element are determined from the predicted pressure in the fluid generated by the first and second impellers. The pressurized fluid is acting on the area in the end of the sealing element and a higher-pressure result in that the area must be reduced to ensure that the balance between the opposite forces exerted on the sealing element remain.

In one embodiment of the pump, the first and second impellers are arranged at different positions along the drive shaft. This design ensures that the desired function is achieved with a limited number of different components in the pump.

In one embodiment of the pump, the power source is a combustion engine, an electrical or hydraulic power source arranged to power the pump. The power source is selected depending on the conditions in the area where the pump is intended to be used.

In one embodiment of the pump, the first end of the sealing element comprises a flange extending in substantially radial direction outwards and the first area is arranged on the flange in the first end of the sealing element, and the second area is arranged on the second end of the sealing element. This embodiment is favourable since the flange makes room for the required larger area facing the first impeller were the pressure in the pumped fluid is lower.

In one embodiment of the pump, the first and second ends of the sealing element, and the surface of the first and second impellers facing the sealing element have corresponding shapes. This embodiment is favourable since the corresponding shapes of the surfaces arranged adjacent to each other reduces the risk for wear and provide guidance for the sealing element during axial movement towards the impellers.

In one embodiment of the pump, the first and second end of the sealing element, and the surface of the first and second impellers facing the sealing element, are substantially transverse to axis A, or conical to axis A or designed with corresponding curved surfaces.

In one embodiment of the pump, the sealing element is between 0.05 to 0.5 mm shorter than the axial distance along axis A between the first and second impellers and the sealing element movable within the same range.

In one embodiment of the pump, the sealing element is between 0.05 to 0.2 mm shorter than the axial distance along axis A between the first and second impellers and the sealing element movable within the same range.

In one embodiment of the pump, an annular elastic sealing is arranged between the sealing element and the pump housing to seal the gap between the sealing element and the interior of the pump housing in the area between the first and second impellers. This elastic sealing separates the space surrounding the sealing element between the first and second impellers such that the higher pressure in the second impeller remains on one side of the elastic sealing and the lower pressure generated by the first impeller remains at the other side of the sealing element.

In one embodiment of the pump, the sealing element is formed by a first sealing element part and a second sealing element part adjustably connected to each other such that the length of the sealing element along axis A is adjustable. This embodiment is very favourable since the sealing element after some time of use will be worn and the length along the axial direction will be reduced. The adjustable connection makes it possible to restore the original intended length of the sealing element and extend the intervals between replacement.

In one embodiment of the pump, the sealing element is made of a metallic, ceramic or plastic material.

In one embodiment of the pump, the first and/or second impeller comprises a removable annular element arranged in the area of the first and/or second impeller intended to be in contact with the sealing element. This embodiment is favourable since also the impellers will be exposed to wear after some time of use. The removable annular element could be replaced in order to avoid, or at least extend the intervals between required replacement of the impellers that are complex and consequently expensive.

The different embodiment described above could of course be combined and modified in different ways without departing from the scope of the invention that will be described more in detail in the detailed description.

BRIEF DESCRIPTION OF THE DRAWINGS

The invention will be explained in more detail hereinafter with reference to the drawings.

All figures are schematic, not necessarily to scale, and generally only illustrating selected parts which are necessary in order to elucidate the invention, wherein other parts may be omitted or merely suggested.

DETAILED DESCRIPTION OF THE EMBODIMENTS

Figure 1:
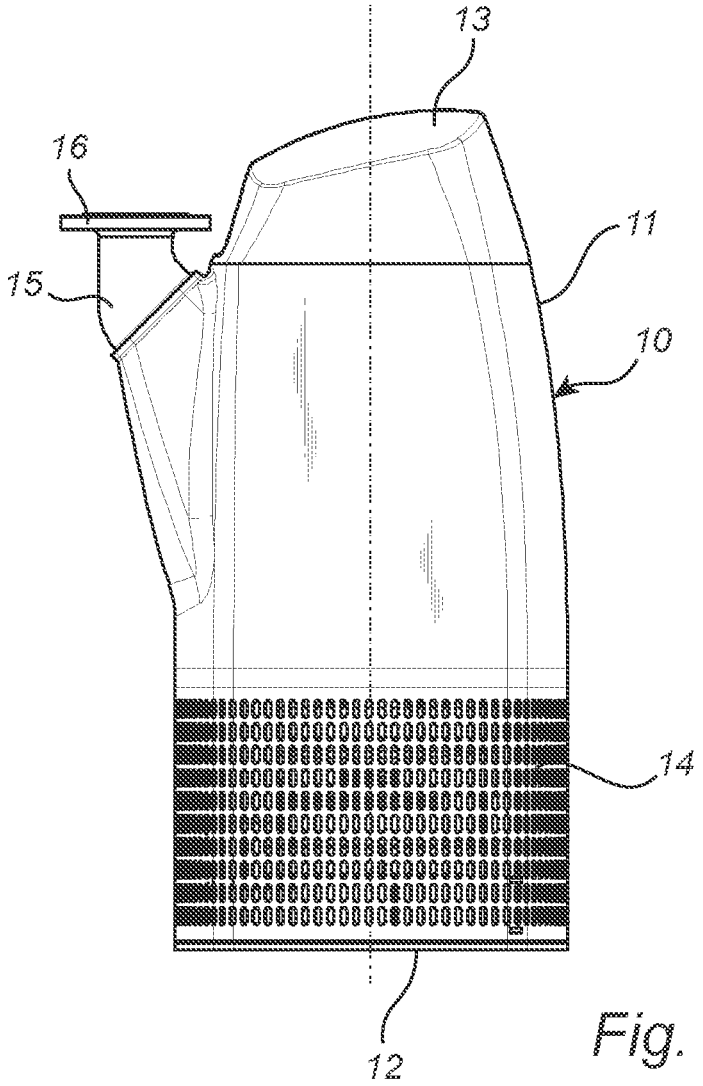
FIG. 1 illustrates a side view of the pump for fluids.
Figure 2A:
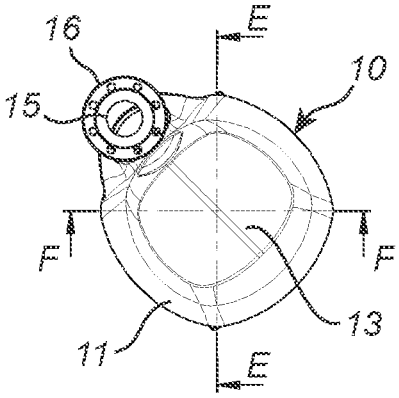
FIG. 2A illustrates a top view of the pump in figure to identify the cross sectional view in FIG. 2B.
Figure 2B:
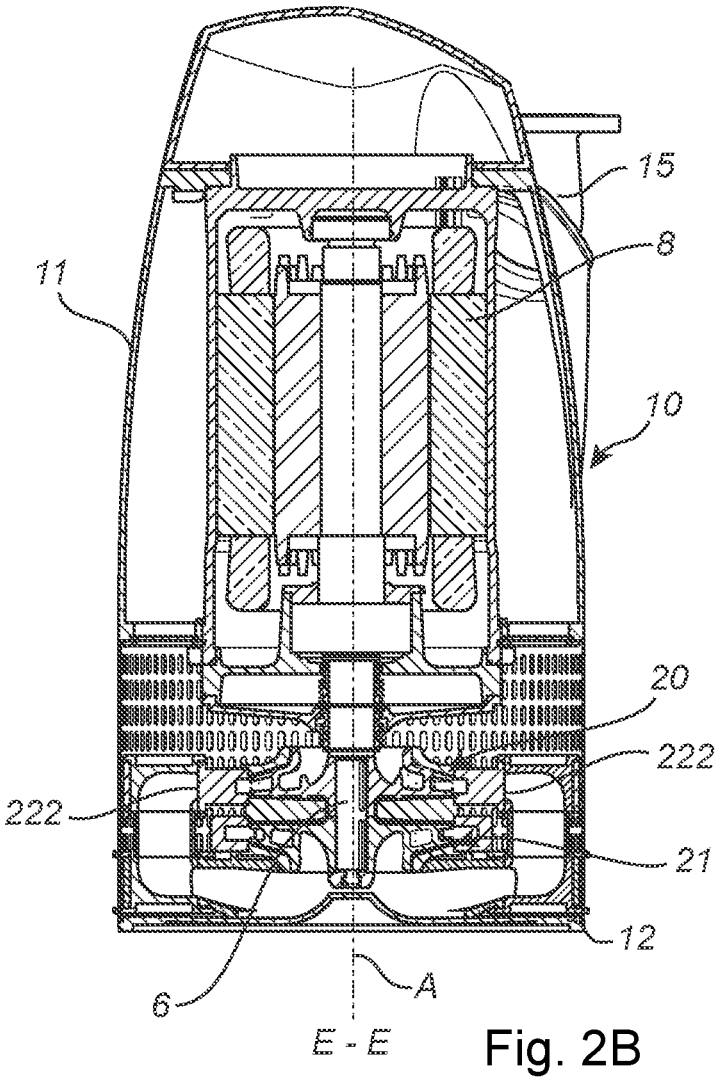
FIG. 2B illustrates a cross-sectional view of the pump through plane E-E.
Figure 2C:
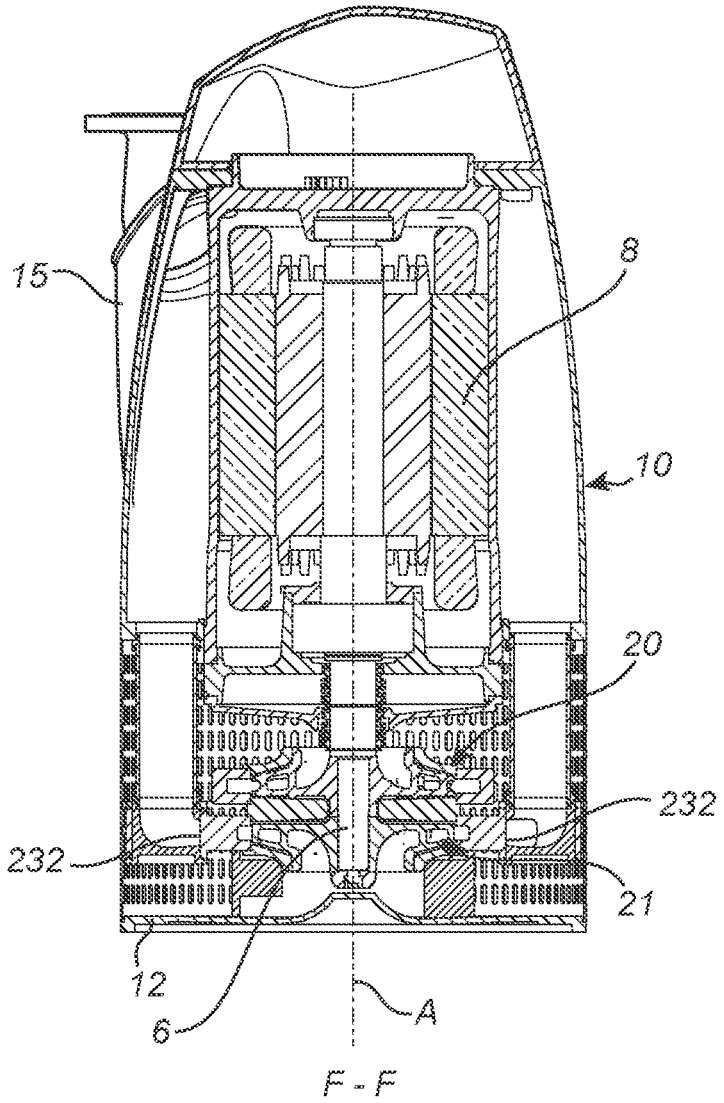
FIG. 2C illustrates a cross-sectional view of the pump through plane F-F.

In FIG. 1 a side view of a pump 10 is illustrated. The pump is intended for pumping fluids such as for example water, possibly containing particles of sand or other materials. The pump comprises a pump housing 11 enclosing and protecting the different parts of the pump. The pump housing has a substantially flat bottom structure 12 intended to be arranged towards a support surface such as for example the ground surface of a mine or pit that needs to be drained.

The illustrated embodiment of the pump housing has a substantially circular cross section with a smaller radius towards the upper end of the pump. The upper end of the pump housing is ended by a top surface 13. Furthermore, since the illustrated pump comprises an electrical power source arranged within the housing, at least one cable for power supply to the pump extends through the pump housing. The at least one cable is not illustrated in FIG. 1 but is preferably arranged close to the upper end of the pump housing. The pump could however also be embodied with the power source arranged separately from the pump and a drive shaft extending from the power source to the pump.

In the lower part of the housing a perforated section 14, i.e. pump inlet, is arranged to let fluid enter the pump. The perforated section prevents that undesired objects enter the pump with the fluid which could affect the operation of the pump and eventually damage the pump. The total area of the perforated section is selected to ensure that enough water always is able to pass through the perforations and enter the water pump. The size of each opening in the perforated section could be adapted based on the intended use of the pump to prevent differently sized objects to pass.

Close to the upper end of the housing, an outlet pipe 15 is arranged. The outlet pipe is intended for the fluid flowing from the pump and is ended by an attachment device 16 to make it possible to connect a pipe or hose with suitable length and dimension to direct the fluid from the pump to the intended place where the drained fluid could be extracted or collected.

The pump 10 comprises an electrical power source/electrical motor 8 arranged within the upper part of the housing in the centre of the housing. The electrical power source is arranged to power the pump via a drive shaft 6 extending along an axis A, substantially parallel to the vertical shaft of the pump, downwards from the electrical motor. The size and power of the power source is selected to correspond to the size and desired pumping capacity of the pump.

The rotating drive shaft 6 is extending downwards to a first 20 and a second pump device 21 arranged along the drive shaft below the electrical motor. The second pump device 21 is arranged closest to the bottom structure 12 of the pump housing and the pump inlet 14, and the first pump device 20 is arranged between the second pump device 21 and the electrical motor 8.

Both the first and second pump devices 20, 21 comprise an impeller 22, 23 rotatably arranged within an impeller chamber 24, 25 with a design corresponding to the impeller. The first and second impellers have the same radius and are arranged inverted to each other along the drive shaft to reduce the loads on the drive shaft and bearings arranged to support the drive shaft and first and second impellers within the pump housing. However, the first and second impellers could have different radius in order to adapt the pump characteristics to specific needs.

The first impeller 22 has the shape of an impeller disk with guiding elements arranged on one side of the disk to generate a flow of fluid through the first pump device 20. The first impeller chamber 24 has at least one impeller chamber inlet 221 in fluid connection with the space defined within the pump housing inside the perforated section 14 of the housing 11 such that a flow of fluid can reach the first impeller chamber inlet 221.

The first pump device 20 furthermore comprises at least one first impeller chamber outlet for the pressurized fluid. The at least one first impeller chamber outlet 222 is in fluid connection with at least one second impeller chamber inlet 231 arranged in the second pump device 21 such that the pressurized fluid from the first pump device 20 is lead to the second pump device 21 in which the pressure in the pumped fluid is raised further by the second impeller 23 before the fluid exits the second pump device via at least one second impeller chamber outlet 232 connected to the outlet pipe 15.

The first impeller 22 and the second impeller 23 are secured to the drive shaft 6 and rotatably arranged within the corresponding impeller chamber arranged within the pump housing. Both impellers rotate with the same speed and direction to generate the desired flow of pressurized fluid through the pump.

The second impeller has the shape of an impeller disk with guiding elements arranged on one side of the disk to generate a flow of fluid through the second pump device. The fluid exits the second pump device via the at least one impeller chamber outlet arranged adjacent to the outer periphery of the second impeller. The at least one outlet is curved upwards and connected to the outlet pipe 15 extending past the electrical power source 8 such that the fluid flowing through the conduit cools the electrical power source when the pump is running and prevents that the power source is over heated.

Figure 3:
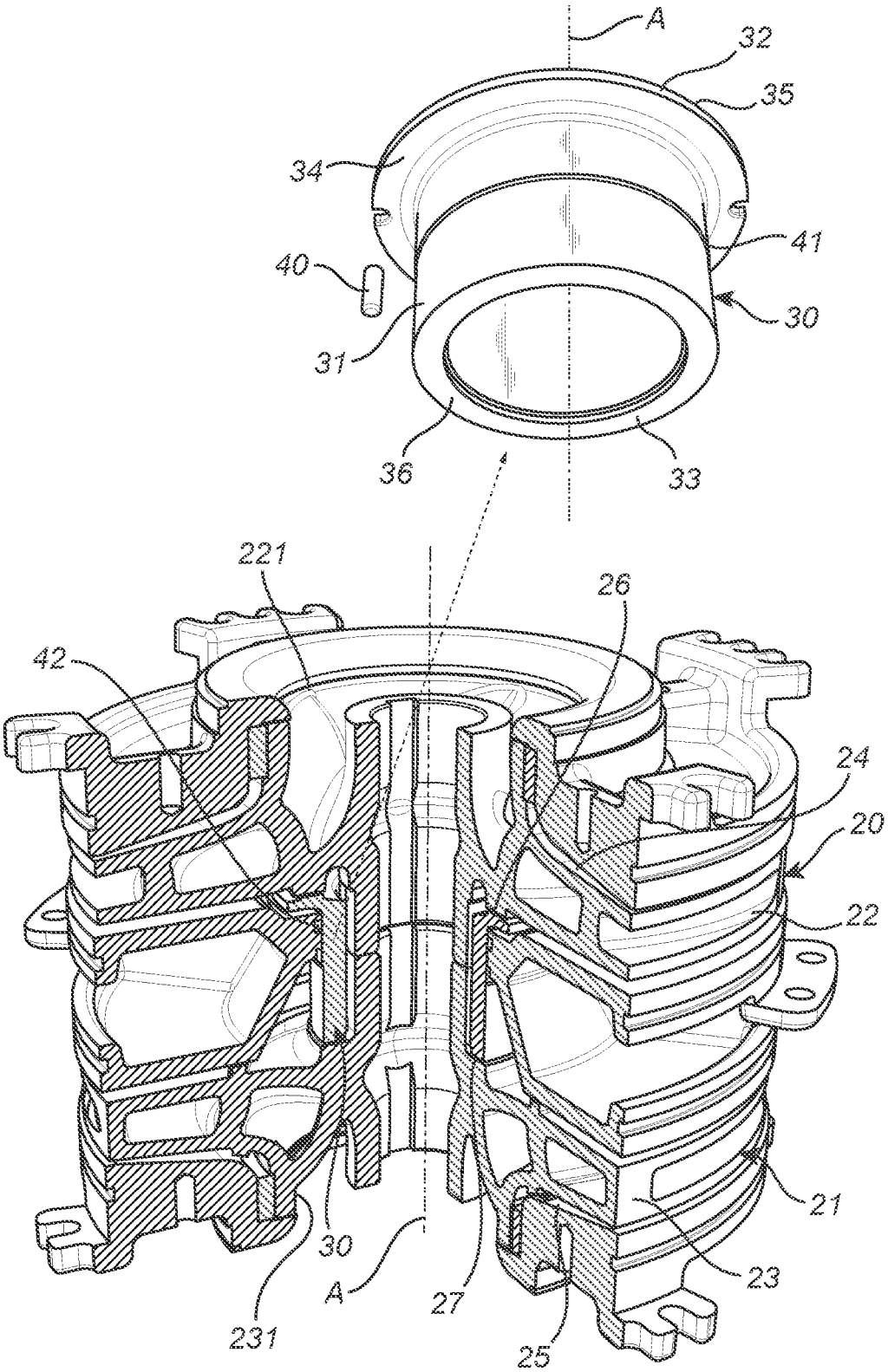
FIG. 3 illustrates the selected parts of the pump according to the invention.

In order to prevent leakage between the first and second pump devices around the drive shaft, a sealing element 30, illustrated in FIG. 3, is arranged within the pump housing between the first and second impellers. The sealing element is sleeve shaped and arranged around the drive shaft 6 between the first 22 and second impeller 23.

The sealing element has a first end 32 arranged adjacent to the first impeller and a second end 33 arranged adjacent to the second impeller. The sealing element has an extension along the axial direction A that is smaller than the distance between an upper side 27 of the second impeller and a lower side 26 of the first impeller such that the sealing element can slide along the drive shaft 6 between a lower end position in which a second end 33 of the sealing element is in contact with the side 27 of the second impeller that is facing the sealing element, i.e. the upper side of the second impeller, and an upper end position in which a first end 32 of the sealing element is in contact with the side 26 of the first impeller that is facing the sealing element, i.e. the lower side of the first impeller.

The sealing element is between 0.05 to 0.5 mm shorter than the axial distance along axis A between the first and second impellers and prevented from rotating in relation to the pump housing.

The sealing element comprises a tube shaped element body 31 and in the first end 32 a flange 34 extend from the element body in substantially radial direction outwards. In the second end 33 of the sealing element a second area 36 is formed on the end surface of the element body of the sealing element, and in the opposite first end a first area 35 is formed on the end surface of the flange. Both the first and second ends of the sealing element and consequently also the first and second areas are substantially transverse to the axial direction A. The first area is arranged on the flange extending in substantially radial direction from the element body at a larger radial direction from the rotational axis A and is larger than the second area. The sealing element is secured in the pump housing by two stop pins 40 secured in the pump housing. The stop pins 40 are extending substantially parallel to the axial direction A and arranged in recesses 42 in the flange in the first end of the sealing element such that the sealing element is able to move along the axial direction along the stop pins. However, other solutions to prevent the sealing element from rotating and still ensure the that the sealing element is able to move in axial direction are possible. The tube shaped element body has circular cross sectional shape transvers to the axial direction A with a constant radius along the element body in order to make it possible to fit the sealing element between the first and second pump devices during assembly of the different components of the pump.

In order to seal the space between the sealing element and the pump housing, an annular elastic sealing is arranged between the outer periphery of the sealing element body and the pump housing. The annular elastic sealing is arranged partly in a groove 41 formed in the outer periphery of the sealing element body to remain in the intended position, alternatively within a groove 42 in the pump housing, to seal the gap between the sealing element and the interior of the pump housing in the area between the first and second impellers.

The area of the first and second areas is selected in combination with the expected pressure in the fluid generated within the first and second pump devices such that the force on the sealing element exerted in axial direction from the pressure within the first pump device acting on the first area is substantially equal to the force on the sealing element exerted in opposite axial direction from the pressure within the second pump device acting on the second area. This means that the sealing element, depending on the actual pressure within the first and second pump devices, will be balanced and move between the two end positions between the first and second impellers. The small gap between the sealing element and the first and second impellers will result in a small leakage from the high pressure side, the second pump device, to the low pressure side, the first pump device, but the volume of this leakage is limited. This arrangement prevents that the pump is damaged because of high friction between the moving parts before the fluid is flowing through the pump.

Figure 4:
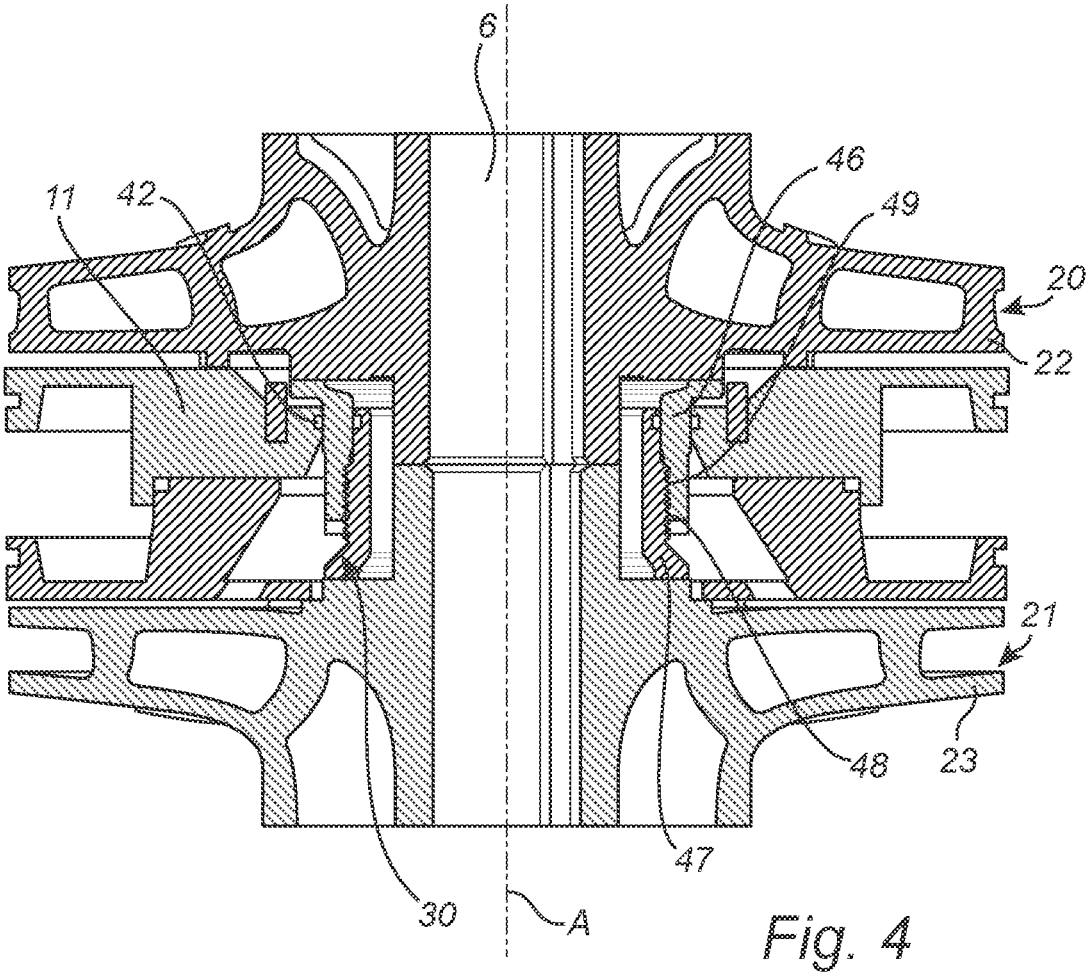
FIG. 4 illustrates a cross-sectional view of selected parts of the pump.

After some time of use, the contact surfaces between the first and second impellers and the sealing element will be exposed to wear. In order to extend the intervals between replacement of the sealing element and/or the impellers, the sealing element could be formed by a first 46 and a second 47 sealing element part, illustrated in FIG. 4, adjustably connected to each other such that the length of the sealing element along axis A is adjustable. The adjustable connection could be achieved by corresponding external 48 and internal treads 49 on the first and second sealing element parts such that the axial length of the sealing element could be increased by turning the first and second sealing element parts in relation to each other.

Furthermore, the first and/or second impeller could comprise a removable annular element arranged in a corresponding recess in the side of the impeller facing the sealing element such that the contact area arranged on the annular element of the first and/or second impeller could be replaced and the intervals between replacement of the impellers extended.

In order to be able to fit the sealing element on the drive shaft, a small gap is formed between the inside surface of the sealing element and the outer periphery of the drive shaft and fluid will flow from the high pressure side, i.e. the second impeller, towards the low pressure side, i.e. the first impeller, and especially if the fluid contains particles there might be areas affected by wear on the drive shaft and the inside of the sealing element, not illustrated in the figures. The time intervals between replacement could be extended if the outside surface of the drive shaft is provided with replaceable sleeve in the area of the sealing element.

The embodiments described above could be combined and modified in different ways without departing from the scope of the invention that is defined by the appended claims.

What is claimed:

1. A pump for fluids, the pump comprising:

a pump housing;

a power source;

a drive shaft connected to the power source and extending along an axis;

a fluid inlet;

a first impeller rotated by the drive shaft and comprising a first impeller inlet in fluid connection with the fluid inlet, and a first impeller outlet;

a second impeller rotated by the drive and comprising a second impeller inlet in fluid connection with the first impeller outlet, and a second impeller outlet; and a sealing element stationarily arranged in relation to the drive shaft and the first and second impellers, the sealing element being sleeve shaped and arranged between the first and second impellers around the drive shaft, the sealing element having a first end transverse to the drive shaft and facing the first impeller and a second end transverse to the drive shaft facing the second impeller, the sealing element having a length along the axis smaller than a distance between the first and second impellers such that the sealing element is movable along the axis between the first and second impellers, the first end of the sealing element having a first area transverse to the axis and the second end having a second area transverse to the axis, and the first area being larger than the second area such that a force exerted by a lower pressure generated by the first impeller and the first area is substantially equal to a force exerted by a higher pressure generated by the second impeller and the second area.

2. The pump according to claim 1, wherein the first and second impellers are arranged at different positions along the drive shaft.

3. The pump according to claim 1, wherein the power source is a combustion engine, an electrical power source or a hydraulic power source and is arranged within the pump housing.

4. The pump according to claim 1, wherein the first end of the sealing element comprises a flange extending in a substantially radial direction outwards and the first area is arranged on the flange in the first end of the sealing element and the second area is arranged on the second end of the sealing element.

5. The pump according to claim 1, wherein the first and second ends of the sealing element, and a surface of each of the first and second impellers facing the sealing element have corresponding shapes.

6. The pump according to claim 5, wherein the first and second ends of the sealing element, and a surface of each of the first and second impellers facing the sealing element, are substantially transverse to the axis, or conical to the axis or configured to have corresponding curved surfaces.

7. The pump according to claim 1, wherein the sealing element is between 0.05 to 0.5 mm shorter than an axial distance along the axis between the first and second impellers and the sealing element is movable within a same range.

8. The pump according to claim 1, wherein the sealing element is between 0.05 to 0.2 mm shorter than an axial distance along the axis between the first and second impellers and the sealing element is movable within a same range.

9. The pump according to claim 1, further comprising an annular elastic sealing arranged between the sealing element and the pump housing to seal a gap between the sealing element and an interior of the pump housing in an area between the first and second impeller.

10. The pump according to claim 1, wherein the sealing element includes a first sealing element part and a second sealing element part adjustably connected to each other such that a length of the sealing element along the axis is adjustable.

11. The pump according to claim 1, wherein the sealing element is a metallic, ceramic or plastic material.

12. The pump according to claim 1, wherein at least one of the first impeller or the second impeller comprises a removable annular element arranged in an area of the at least one of the first impeller or the second impeller and configured to be in contact with the sealing element.

* * * * *